US011708687B1

(12) United States Patent
Milton et al.

(10) Patent No.: US 11,708,687 B1
(45) Date of Patent: Jul. 25, 2023

(54) MOBILE FIRE HYDRANT APPARATUS AND METHOD OF PROVIDING WATER FOR FIREFIGHTING

(71) Applicants: Daniel R. Milton, Shingle Springs, CA (US); Joshua F. Boling, Shingle Springs, CA (US); Michael J. Milton, Shingle Springs, CA (US)

(72) Inventors: Daniel R. Milton, Shingle Springs, CA (US); Joshua F. Boling, Shingle Springs, CA (US); Michael J. Milton, Shingle Springs, CA (US)

( * ) Notice: Subject to any disclaimer, the term of this patent is extended or adjusted under 35 U.S.C. 154(b) by 0 days.

(21) Appl. No.: 18/069,131

(22) Filed: Dec. 20, 2022

Related U.S. Application Data

(60) Provisional application No. 63/416,014, filed on Oct. 14, 2022.

(51) Int. Cl.
*E03B 9/04* (2006.01)
*A62C 3/02* (2006.01)

(52) U.S. Cl.
CPC ..... *E03B 9/04* (2013.01); *A62C 3/0292* (2013.01)

(58) Field of Classification Search
CPC ..... E03B 9/04; A62C 3/0292
See application file for complete search history.

(56) References Cited

U.S. PATENT DOCUMENTS

| | | | | |
|---|---|---|---|---|
| 3,169,581 | A * | 2/1965 | Cummins | A62C 3/08 280/4 |
| 10,018,195 | B1 * | 7/2018 | McLoughlin | F04B 49/08 |
| 2007/0164127 | A1 * | 7/2007 | Lozier | A62C 37/36 222/25 |
| 2011/0266009 | A1 * | 11/2011 | Liu | A62C 27/00 169/52 |
| 2012/0000680 | A1 * | 1/2012 | Guse | A62C 25/00 169/44 |
| 2018/0236281 | A1 * | 8/2018 | Jutras | A62C 25/005 |
| 2019/0299038 | A1 * | 10/2019 | Hernandez | B05B 9/007 |
| 2020/0147428 | A1 * | 5/2020 | Burdin | A62C 37/04 |
| 2020/0215372 | A1 * | 7/2020 | LaVergne | A62D 1/0071 |
| 2021/0138281 | A1 * | 5/2021 | Nohmi | B64D 1/16 |
| 2021/0221703 | A1 * | 7/2021 | Wilkinson | C02F 1/004 |

* cited by examiner

*Primary Examiner* — Kevin R Barss
(74) *Attorney, Agent, or Firm* — O'Banion & Ritchey LLP; John P. O'Banion

(57) ABSTRACT

A mobile fire hydrant (MFH) has a substantially planar rectangular base of tubing elements, with an inlet that connects to an ascending portion which has an outlet, generally configured as a fire hydrant outlet. Water or other fire abatement fluid, is pumped from a source to the MFH inlet, which then exits from the outlet in a manner very similar to that of a permanent fire hydrant. A switch mounted on the MFH controls the pump remotely through a pump cable as needed, allowing remote access to water sources at locations beyond 300 feet in distance and 75 in height, depending on pump specifications. This allows ease of water supply for firefighting in remote steep areas with streams or lakes otherwise inaccessible to firefighting equipment.

22 Claims, 5 Drawing Sheets

MOBILE FIRE HYDRANT APPARATUS AND METHOD OF PROVIDING WATER FOR FIREFIGHTING

CROSS-REFERENCE TO RELATED APPLICATIONS

This application claims priority to, and the benefit of, U.S. provisional patent application Ser. No. 63/416,014 filed on Oct. 14, 2022, incorporated herein by reference in its entirety.

NOTICE OF MATERIAL SUBJECT TO COPYRIGHT PROTECTION

A portion of the material in this patent document may be subject to copyright protection under the copyright laws of the United States and of other countries. The owner of the copyright rights has no objection to the facsimile reproduction by anyone of the patent document or the patent disclosure, as it appears in the United States Patent and Trademark Office publicly available file or records, but otherwise reserves all copyright rights whatsoever. The copyright owner does not hereby waive any of its rights to have this patent document maintained in secrecy, including without limitation its rights pursuant to 37 C.F.R. § 1.14.

STATEMENT REGARDING FEDERALLY SPONSORED RESEARCH OR DEVELOPMENT

Not Applicable

BACKGROUND

1. Technical Field

The technology of this disclosure pertains generally to firefighting, and more particularly to forest fire fighting where installed fire hydrants are remote.

2. Background Discussion

Providing water for firefighting at remote locations where a wildfire incident may occur is frequently solved by emergency personnel "shuttling" water loads to designated drop points where water is not otherwise available. At such drop points emergency personnel will stage large open pools that act as temporary storage tanks. These temporary storage tanks are capable of holding thousands of gallons of water for personnel to draw from and return to the incident fire line. However, such water stations are highly deficient in nature, as they can only refill so many tank truck units to disperse back to the fire line before needing to be replenished via trucks circling back to refill them. During this "shuttling" operation trucks must drive to either a city water connection, or an accessible body of water from which to draw. However, locations that support the drafting of water by equipment such as a firetruck, or water truck, are in short supply. All too often rivers, streams, and large bodies of water are distant from accessible roadways that a firetruck, tank truck, or water truck would be able to transverse to obtain such natural water sources.

BRIEF SUMMARY

In this disclosure, a method and apparatus is described for delivering water or other fluid from a typically inaccessible source to an access point, known as a mobile fire hydrant. Such sources may be lakes, streams, ponds, pools, and the like that are down steep inclines that firefighting equipment cannot readily, and timely, access. Additionally, not all fires occur in regions where fire hydrants are extant. Hence, the mobile fire hydrant describes here serves the purpose of providing water access where firefighting infrastructure, such as installed hydrants, are not available.

The mobile fire hydrant may be used for continuous water supply to a mobile tank when warranted. Otherwise, the mobile fire hydrant is used only to fill a mobile tank, and then the remote pump is turned off to conserve fuel. The remote pump is actuated by a switch on the mobile fire hydrant. Although the switch is shown in the drawings below as permanently mounted on the mobile fire hydrant, it could be temporarily or permanently detached as the need occurs. As used herein, a "mobile tank" can include, without limitation, a movable tank, a tanker truck, a pumper truck, a fire truck, a water tender, a portable folding tank, a trailer mounted tank, or other container that is capable of holding water for dispensing. Reference to one type of mobile tank herein does not exclude another type of mobile tank being used in its place.

Further aspects of the technology described herein will be brought out in the following portions of the specification, wherein the detailed description is for the purpose of fully disclosing preferred embodiments of the technology without placing limitations thereon.

BRIEF DESCRIPTION OF THE DRAWINGS

The technology described herein will be more fully understood by reference to the following drawings which are for illustrative purposes only.

DETAILED DESCRIPTION

Figure 1:
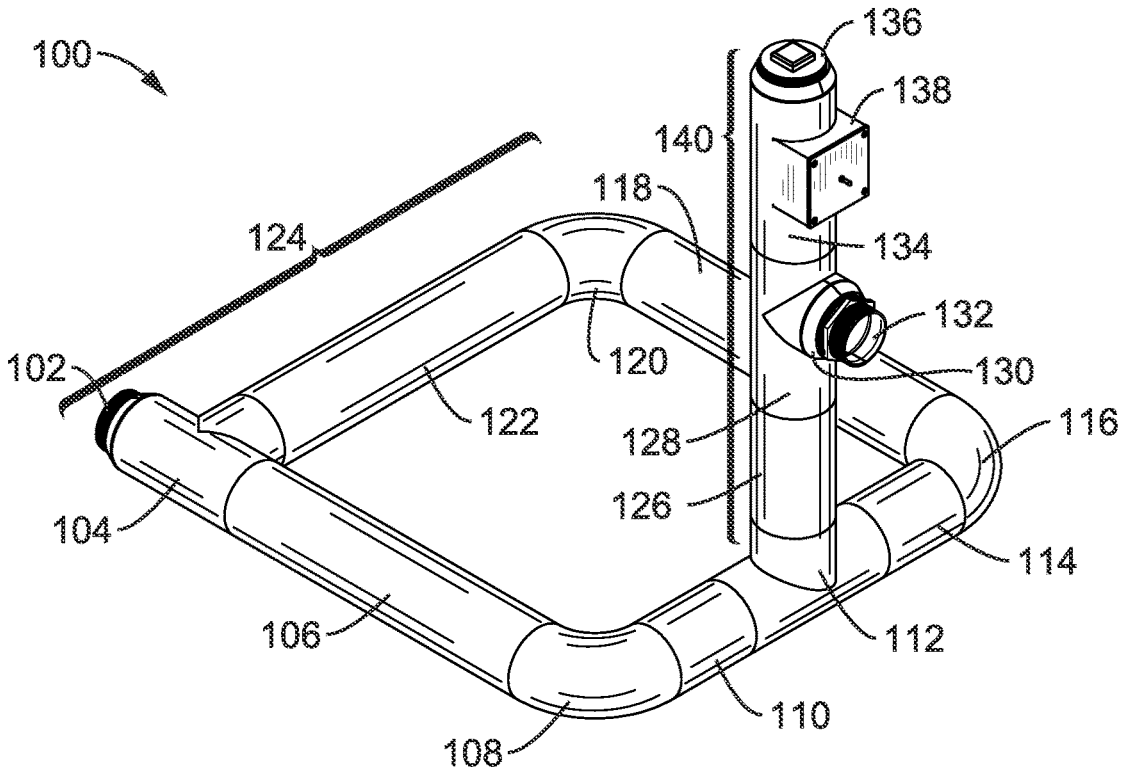
FIG. 1 is a perspective view of an embodiment of a mobile fire hydrant apparatus according to the technology of this disclosure.

During a wildfire incident, important resources including accessible water are often hours away from the site of the incident, or too far from roads to be viable as a firefighting water source. Having water close to an incident when needed it is of paramount importance to successfully fighting a fire. It is not uncommon for equipment to need to travel for an extended amount of time to wherever water is available for refilling. Sometimes this means forgoing drawing water from a closer source simply because the water is physically inaccessible. Valuable time and resources are often consumed by the act of obtaining water to fight the fire.

The mobile fire hydrant described herein is designed to meet the needs of emergency personnel without requiring access to city water connections that may not be close to the incident of the fire. The mobile fire hydrant can pull water from any source of water and dispense it to a remote location located hundreds of feet away and up steep inclines where flowing bodies of water often reside. The mobile fire hydrant described herein provides water on demand once setup in the required location.

The mobile fire hydrant dispenses water via a connection to a pump located at a station that may be quite distant from the hydrant. Through a series of hose connections and a proprietary electrical switch the mobile fire hydrant turns off and on as needed to dispense water through a standard firefighting fitting located on the mobile fire hydrant.

Typically, the pump is located within self-priming distance of a suitable water source, such as, but not limited to lakes, ponds, streams, rivers, pools, hot tubs, etc. Such pump would be limited in vertical distance to a maximum of about 32 vertical feet (atmospheric pressure at mean sea level) from the water source, but more practically to the self-priming head limit of the particular pump being used.

Alternatively, and not shown here, a submersible pump may be directly deposited in the water source, thereby eliminating the self priming head limit.

The mobile fire hydrant has multiple functions as well besides dispersing water to a remote location. The mobile fire hydrant can operate as: a sprinkler station; a fire-retardant mixing and dispensing station; a water supply to a helicopter-based retardant station; and as a station for transferring water to larger tanks for further distribution via an additional pump to an overhead fill station.

The mobile hydrant would be able to have a strategic placement near an available water source to replenish emergency personnel water supply to the limits of the water source. This alleviates the need for equipment to drive back and forth to fill temporary storage tanks, and any logistic challenges such mobile tanks may incur on their way back and forth to the city water sources, or other accessible drafting locations. The mobile fire hydrant also generally alleviates the need for the temporary storage tanks themselves.

In the following description, the "T" sections/elements comprise a vertical "stem" connecting to the top of the letter in the horizontal stroke, which is called an "arm". The stem bisects the stem.

Refer now to FIG. 1, which is a drawing of a mobile hydrant 100. Here, a female receptacle 102 is available for attachment to an incoming hose (not shown here). The female receptacle 102 is attached to a first "T" section 104 at one end of the arm, which in turn sequentially attaches to a first pipe section 106 at the second end of the arm, a first "L" section 108, a second pipe section 110, a second "T" section 112 with a vertically oriented stem, a third pipe section 114, a second "L" section 116, a fourth pipe section 118, a third "L" section 120, a fifth pipe section 122, which terminates into the original first "T" section 104 stem. The foregoing arrangement forms a substantially planar and substantially rectangular base 124. In this illustration the base 124 appears substantially square in aspect.

Female receptacle 102 is typically a 3-inch NPT fitting for supply of water to the mobile hydrant 100.

A first vertical pipe section 126 is attached to the second "T" section stem 112 at one end, while the other end of the first vertical pipe section 126 terminates in the lower bar of a vertical "T" section 128. The vertical "T" section 128 terminates on its stem with an adapter 130 to which is attached a threaded male bung 2.5" national hose fitting 132 for discharge of water supply out the mobile hydrant 100.

Continuing vertically upward, a second vertical pipe section 134 ascends from a topmost bar of the vertical "T" section 128. The second vertical pipe section 134 finally terminates with a plug 136 when flushing of the interior of the mobile hydrant 100 is desired. Plug 136 may also be utilized for connection of a sprinkler system, or other such systems.

Finally, a junction box 138 is attached to the second vertical pipe section 134. The junction box 138 allows for controlled electrical connections as further described below.

The ascending portion 140 is generally oriented away from the water source entering into female receptacle 102 of the mobile hydrant 100, but is not limited to such orientation.

The ascending portion 140 is typically vertically ascending, but is not limited to such orientation.

Figure 2:
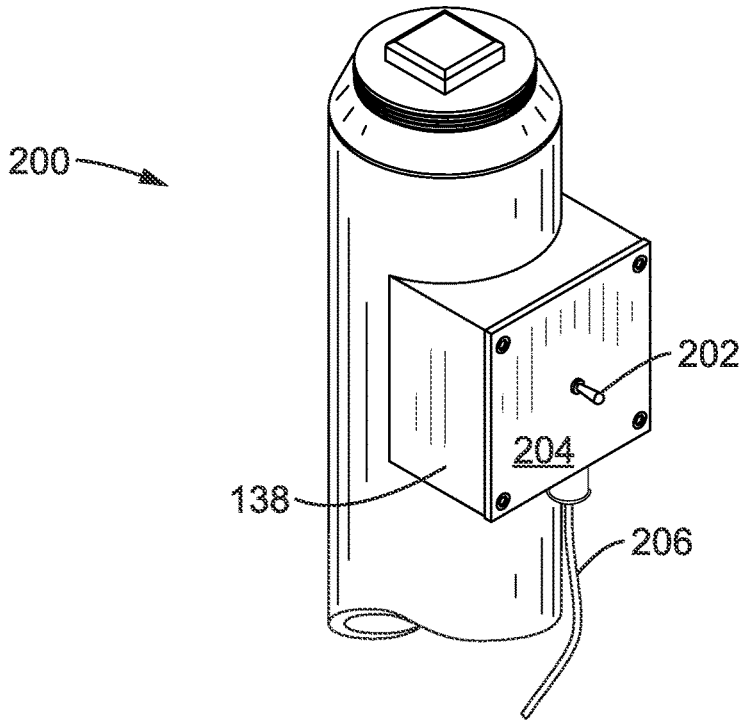
FIG. 2 is a close-up view of the switching top portion of the mobile fire hydrant apparatus of FIG. 1.

Refer now to FIG. 2, which is an enlargement of the topmost section 200 of the mobile fire hydrant 100 of FIG. 1, where a single pole, double throw (SPDT) switch 202 has been installed onto a cover plate 204, which has in turn been attached to the junction box 138 previously shown in FIG. 1. From the junction box 138 descends a switch cable 206, which is ultimately used for controlling a pump.

It should be noted that the junction box 138 and switch 202 are preferably permanently mounted to the mobile fire hydrant 100 of FIG. 1. However, such permanent mounting is not a requirement, and in fact, such mounting may be made detachable for convenience.

The topmost section 200 of the mobile hydrant 100 is where control of the mobile hydrant 100 occurs in terms of making water available to the female threaded plug receptacle male bung 2.5" national hose fitting 132 of FIG. 1. This control occurs through actuation of the switch 202, which energizes the pump.

Figure 3:
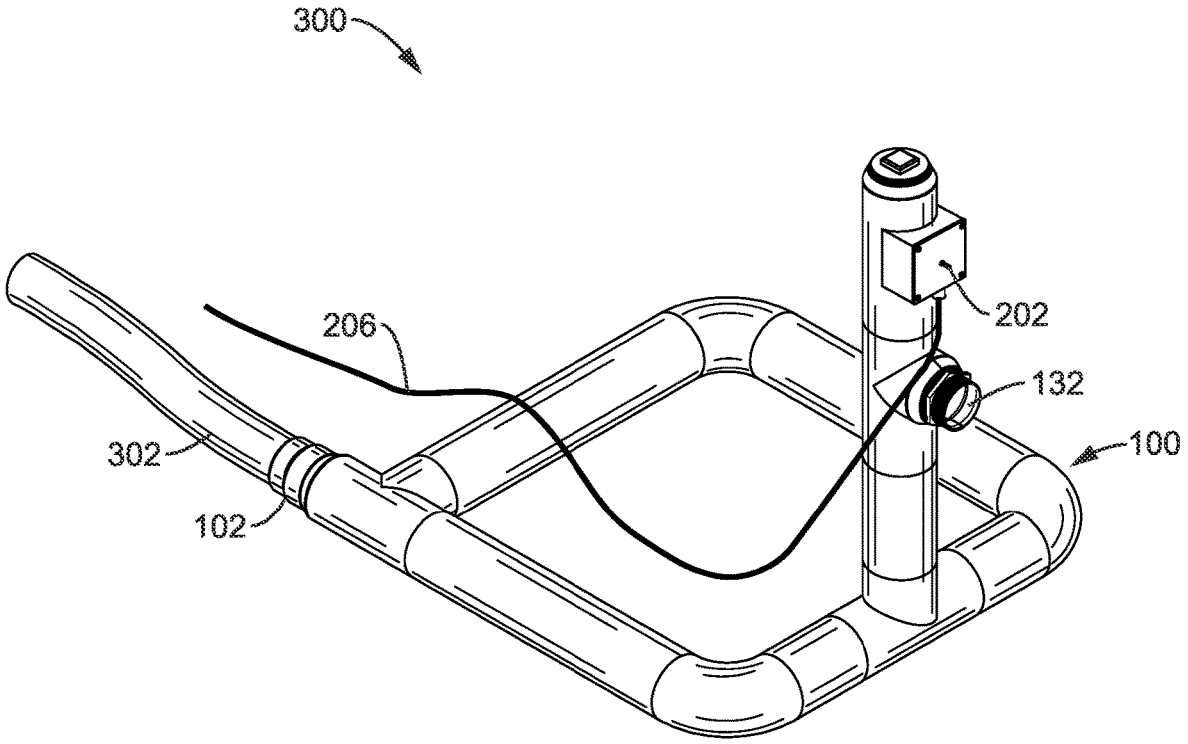
FIG. 3 is a perspective view of an embodiment of mobile fire hydrant apparatus with a supply hose and control line connected according to the technology of this disclosure.

Refer now to FIG. 3, which is a perspective view 300 of the mobile hydrant 100 attached to an input hose 302 at the female receptacle 102. Actuation of the switch 202 causes a signal to pass through switch cable 206, which actuates a pump (described below) to cause water to pass through input hose 302 and exit through male bung 2.5" national hose fitting 132. It should be noted that the hose fitting 132 could be any size and could be either male or female gender, however, typically fire hydrants are male 2.5" national hose fittings.

The input hose 302 is most typically a 3" lay flat hose widely used by firefighters but could be any hose capable of conveying water, flame retardant, or other liquid.

Figure 4:
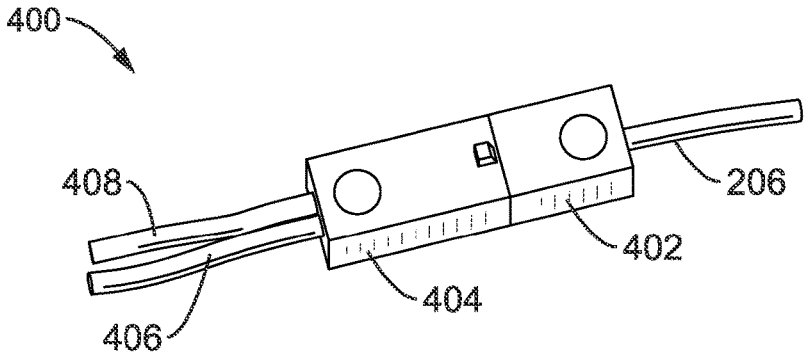
FIG. 4 is a perspective view of an embodiment of a cable connection for a mobile fire hydrant apparatus according to the technology of this disclosure.

Refer now to FIG. 4, which is a drawing 400 of switch cable 206 terminating in switch connector 402, which is electrically connected to pump connector 404. Exiting the pump connector 404 are bottom float cable 406 and top float cable 408, both of which are electrically connected to a pump as further described below.

Figure 5:
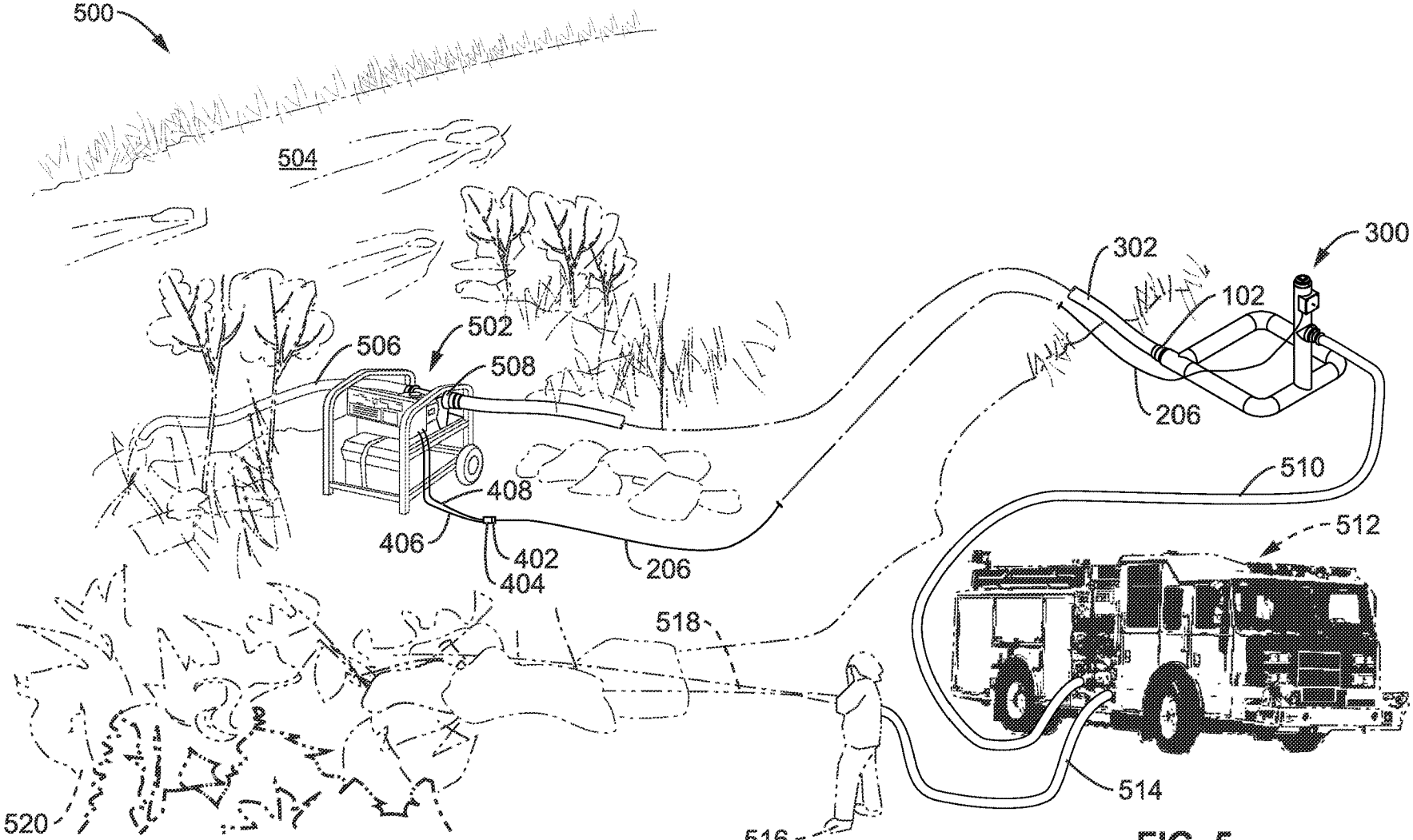
FIG. 5 is a perspective view of a pump feeding from a water source, providing water to a mobile fire hydrant, which in turn may either: 1) directly supply a mobile tank to feed a firefighter that is fighting a fire, or 2) indirectly filling just the mobile tank for subsequent fire fighting (not shown) according to an embodiment of the technology of this disclosure.

Refer now to FIG. 5, which is an unscaled FIG. 500 of a pump 502 drawing water from a water source 504 (here, the source is shown as a stream) through an input hose 506 to a pump 502 output fitting 508 to mobile hydrant 100 female receptacle 102 through input hose 302. From the pump 502 output fitting 508 is an output hose 510 fluidly connected to a mobile tank 512 (illustrated in FIG. 5 as a fire truck). The mobile tank 512 that in turn has a final output hose 514, from which a firefighter 516 may direct a stream 518 of firefighting fluid (typically water or foam) toward a fire 520 or smoldering fire (not shown here) for fire containment.

Figure 6:
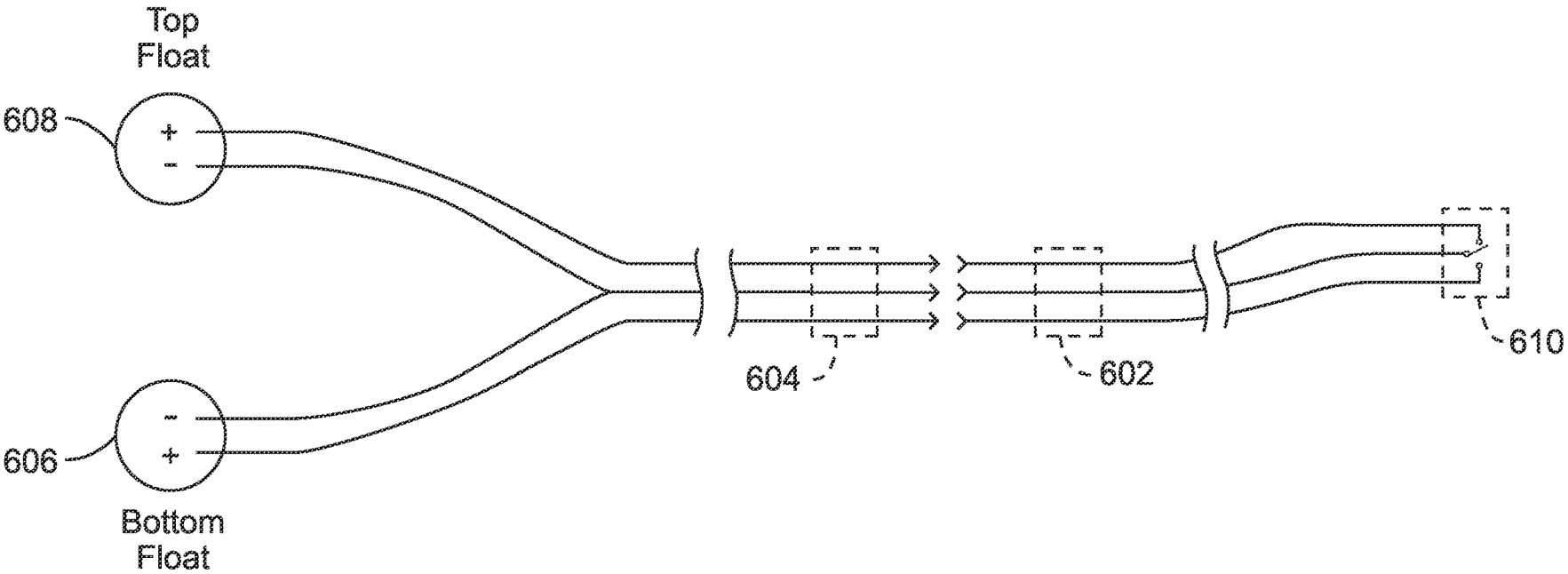
FIG. 6 is a schematic of an embodiment of a control cable capable of actuating a pump from a switch mounted on the mobile fire hydrant apparatus according to the technology of this disclosure.

Refer now to FIG. 6, which is a wiring schematic of a pump control wiring harness 600. Here, we see a control connector 602 (402 in FIG. 4) connected to a pump connector 604 (404 in FIG. 4), which in turn connects to the bottom float 606 (406 in FIG. 4) and the top float 608 (408 in FIG. 4). Here, it is noted that the bottom float negative signal is electrically connected to the top float 608 negative signal at the pump connector 604. Pump activation is achieved through actuation of switch 610 (202 of FIG. 2).

With pump control harness 600 the float features that are standard features on the pump are replaced with a single switch. It should be noted that this particular wiring is not supported or offered by the pump manufacturer.

Figure 7:
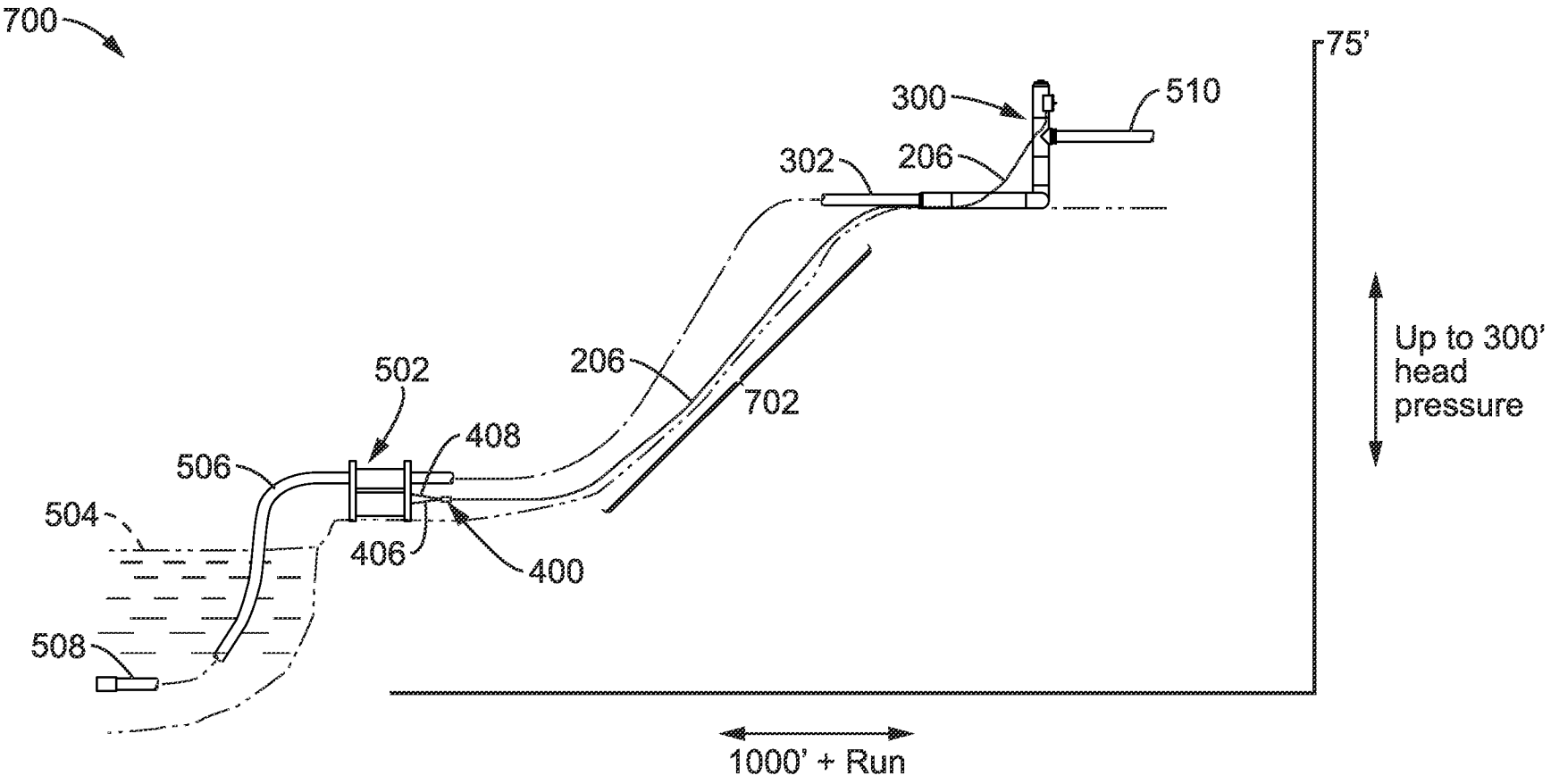
FIG. 7 is a fire hose line showing water being sourced from a supply to a pump, up an incline, and connected with a mobile fire hydrant apparatus according to an embodiment of the technology of this disclosure.

Refer now to FIG. 7, which is a graph 700 of the fire hose showing water being pumped from a water source 504 to a pump 502 through an input hose 506 (typically referred to as a hard suction line), up and incline 702, and connected with a mobile file hydrant 300. Depending on the pump specifications, the water may be pumped more than 1000 feet from the pump 502, and up to 300 feet or more vertically.

As shown in this FIG. 7, the various components of the mobile fire hydrant 300 and pump 502 work together to complete the task of pumping large volumes of water from water source 504 to an accessible area from an otherwise inaccessible area. From the mobile fire hydrant 300, water may be dispensed via its connections to emergency personnel and their vehicles as needed, and on command.

Although embodiments herein have been described using hardwired controls such as switches and associated cabling, it will be appreciated that wireless controls can be used as well. For example, wireless transmitters and receivers, and associated relays, servos and other switching control devices could be used. Furthermore, float type switches could be used as alternative to manually operated switches where appropriate.

From the description herein, it will be appreciated that the present disclosure encompasses multiple implementations of the technology which include, but are not limited to, the following:

A mobile fire hydrant apparatus, comprising: (a) a substantially planar rectangular base; (b) a vertically ascending portion that ascends in a substantially perpendicular direction from said base; (c) a first receptacle disposed within said base; and (d) a second receptacle disposed within said vertically ascending portion; (e) wherein a fluid input into the first receptacle will exit from the second receptacle after traversal of a least a portion of said base and said vertically ascending portion.

The apparatus of any preceding or following implementation, further comprising: (a) a switch configured to control a flow of the fluid as either on or off; (b) wherein said switch is disposed on said vertically ascending section.

The apparatus of any preceding or following implementation, wherein said switch is either removably or permanently disposed on said vertically ascending portion.

The apparatus of any preceding or following implementation, further comprising: (a) a switch cable electrically connected to said switch; wherein said switch cable terminates at a switch connector.

The apparatus of any preceding or following implementation, further comprising: (a) a pump connector, comprising a top float cable and a bottom float cable; (b) a pump, comprising a top float sensor input and a bottom float sensor input; (c) wherein operation of the pump is controlled on or off by the top float sensor input and the bottom float sensor input; (d) wherein the top float cable is attached to the top float sensor input, and wherein the bottom float cable is connected to the bottom float sensor input; (e) wherein the switch cable is connected to the pump connector; and (f) wherein the pump connector comprises a connection that electrically links the top float cable and the bottom float cable in at least one place.

The apparatus of any preceding or following implementation, wherein the first receptacle is configured to receive a hard suction hose.

The apparatus of any preceding or following implementation, wherein the second receptacle is configured as a fire hydrant outlet.

The apparatus of any preceding or following implementation, wherein said base and said vertically ascending portion comprise a material selected from the group consisting of copper piping, steel piping, stainless steel piping, galvanized steel piping, aluminum piping, a metal, a plastic, and polyvinylchloride (PVC).

A mobile fire hydrant apparatus, comprising: (a) a substantially planar rectangular base, comprising a first receptacle; and (b) an ascending section, comprising a second receptacle; (c) wherein the ascending section ascends from the rectangular base; and (d) wherein the first and second receptacles are in fluid communication through the rectangular base and the ascending section.

The apparatus of any preceding or following implementation, further comprising a switch available to control a flow of the fluid as either on or off.

The apparatus of any preceding or following implementation, wherein the switch is disposed on the ascending portion.

The apparatus of any preceding or following implementation, further comprising: (a) a switch cable electrically connected to the switch; (b) wherein the switch cable terminates at a switch connector.

The apparatus of any preceding or following implementation, further comprising: (a) a pump connector, comprising a top float cable and a bottom float cable; (b) a pump, comprising a top float sensor input and a bottom float sensor input; (c) wherein operation of the pump is controlled on or off by the top float sensor input and the bottom float sensor input; (d) wherein the top float cable is attached to the top float sensor input, and the bottom float cable is connected to the bottom float sensor input; (e) wherein the switch cable is connected to the pump connector; and (f) wherein the pump connector comprises an electrical connection between the top float cable and the bottom float cable in at least one place.

The apparatus of any preceding or following implementation, wherein the first receptacle is configured to receive a hose.

The apparatus of any preceding or following implementation, wherein the second receptacle is configured to be a fire hydrant outlet.

The apparatus of any preceding or following implementation 9, wherein the rectangular base and the ascending portion are selected from a set of materials comprising: copper piping, steel piping, stainless steel piping, galvanized steel piping, aluminum piping, a metal, a plastic, and polyvinylchloride (PVC).

A method of pumping water from a source, comprising: (a) providing a pump having a pump inlet and a pump outlet;

(b) providing a mobile fire hydrant apparatus in fluid connection with the pump outlet at a first receptacle, the apparatus disposed at a distance from the source; (c) wherein the apparatus comprises: (i) a substantially planar rectangular base, comprising the first receptacle; (ii) an ascending section, comprising a second receptacle; (iii) wherein the ascending section ascends from the rectangular base; and wherein the first and second receptacles are in fluid communication through the rectangular base and the ascending section; and (d) providing a hard suction hose between the water source and the pump inlet.

The method of any preceding or following implementation, further comprising providing a switch available to control a flow of the water as either on or off.

The method of any preceding or following implementation, wherein the switch is either removably or permanently disposed on the vertically ascending portion.

The method of any preceding or following implementation, further comprising: (a) providing a switch cable electrically connected to the switch; (b) wherein the switch cable terminates at a switch connector.

The method of any preceding or following implementation, further comprising: (a) providing a pump connector, comprising a top float cable and a bottom float cable; (b) providing a pump, comprising a top float sensor input and a bottom float sensor input; (c) wherein operation of the pump is controlled on or off by the top float sensor input and the bottom float sensor input; (d) wherein the top float cable is attached to the top float sensor input, and the bottom float cable is connected to the bottom float sensor input; (e) wherein the switch cable is connected to the pump connector; and (f) providing an electrical connection linking the top float cable and the bottom float cable together in at least one place.

The method of any preceding or following implementation, wherein the first receptacle is configured to receive a hose fluidly connecting the pump and the apparatus.

The method of any preceding or following implementation, wherein the second receptacle is configured to be a fire hydrant outlet.

The method of any preceding or following implementation, wherein the rectangular base and the ascending portion are selected from a set of materials comprising: copper piping, steel piping, stainless steel piping, galvanized steel piping, aluminum piping, a metal, a plastic, and polyvinylchloride (PVC).

As used herein, term "implementation" is intended to include, without limitation, embodiments, examples, or other forms of practicing the technology described herein.

As used herein, the singular terms "a," "an," and "the" may include plural referents unless the context clearly dictates otherwise. Reference to an object in the singular is not intended to mean "one and only one" unless explicitly so stated, but rather "one or more."

Phrasing constructs, such as "A, B and/or C", within the present disclosure describe where either A, B, or C can be present, or any combination of items A, B and C. Phrasing constructs indicating, such as "at least one of" followed by listing a group of elements, indicates that at least one of these group elements is present, which includes any possible combination of the listed elements as applicable.

References in this disclosure referring to "an embodiment", "at least one embodiment" or similar embodiment wording indicates that a particular feature, structure, or characteristic described in connection with a described embodiment is included in at least one embodiment of the present disclosure. Thus, these various embodiment phrases are not necessarily all referring to the same embodiment, or to a specific embodiment which differs from all the other embodiments being described. The embodiment phrasing should be construed to mean that the particular features, structures, or characteristics of a given embodiment may be combined in any suitable manner in one or more embodiments of the disclosed apparatus, system or method.

As used herein, the term "set" refers to a collection of one or more objects. Thus, for example, a set of objects can include a single object or multiple objects.

Relational terms such as first and second, top and bottom, upper and lower, left and right, and the like may be used solely to distinguish one entity or action from another entity or action without necessarily requiring or implying any actual such relationship or order between such entities or actions.

The terms "comprises," "comprising," "has", "having," "includes", "including," "contains", "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a", "has . . . a", "includes . . . a", "contains . . . a" does not, without more constraints, preclude the existence of additional identical elements in the process, method, article, or apparatus that comprises, has, includes, contains the element.

As used herein, the terms "approximately", "approximate", "substantially", "essentially", and "about", or any other version thereof, are used to describe and account for small variations. When used in conjunction with an event or circumstance, the terms can refer to instances in which the event or circumstance occurs precisely as well as instances in which the event or circumstance occurs to a close approximation. When used in conjunction with a numerical value, the terms can refer to a range of variation of less than or equal to ±10% of that numerical value, such as less than or equal to ±5%, less than or equal to ±4%, less than or equal to ±3%, less than or equal to ±2%, less than or equal to ±1%, less than or equal to ±0.5%, less than or equal to ±0.1%, or less than or equal to ±0.05%. For example, "substantially" aligned can refer to a range of angular variation of less than or equal to ±10°, such as less than or equal to ±5°, less than or equal to ±4°, less than or equal to ±3°, less than or equal to ±2°, less than or equal to ±1°, less than or equal to ±0.5°, less than or equal to ±0.1°, or less than or equal to ±0.05°.

Additionally, amounts, ratios, and other numerical values may sometimes be presented herein in a range format. It is to be understood that such range format is used for convenience and brevity and should be understood flexibly to include numerical values explicitly specified as limits of a range, but also to include all individual numerical values or sub-ranges encompassed within that range as if each numerical value and sub-range is explicitly specified. For example, a ratio in the range of about 1 to about 200 should be understood to include the explicitly recited limits of about 1 and about 200, but also to include individual ratios such as about 2, about 3, and about 4, and sub-ranges such as about 10 to about 50, about 20 to about 100, and so forth.

The term "coupled" as used herein is defined as connected, although not necessarily directly and not necessarily mechanically. A device or structure that is "configured" in a certain way is configured in at least that way, but may also be configured in ways that are not listed.

Benefits, advantages, solutions to problems, and any element(s) that may cause any benefit, advantage, or solution to occur or become more pronounced are not to be construed as a critical, required, or essential features or elements of the technology describes herein or any or all the claims.

In addition, in the foregoing disclosure various features may be grouped together in various embodiments for the purpose of streamlining the disclosure. This method of disclosure is not to be interpreted as reflecting an intention that the claimed embodiments require more features than are expressly recited in each claim. Inventive subject matter can lie in less than all features of a single disclosed embodiment.

The abstract of the disclosure is provided to allow the reader to quickly ascertain the nature of the technical disclosure. It is submitted with the understanding that it will not be used to interpret or limit the scope or meaning of the claims.

It will be appreciated that the practice of some jurisdictions may require deletion of one or more portions of the disclosure after that application is filed. Accordingly, the reader should consult the application as filed for the original content of the disclosure. Any deletion of content of the disclosure should not be construed as a disclaimer, forfeiture or dedication to the public of any subject matter of the application as originally filed.

The following claims are hereby incorporated into the disclosure, with each claim standing on its own as a separately claimed subject matter.

Although the description herein contains many details, these should not be construed as limiting the scope of the disclosure but as merely providing illustrations of some of the presently preferred embodiments. Therefore, it will be appreciated that the scope of the disclosure fully encompasses other embodiments which may become obvious to those skilled in the art.

All structural and functional equivalents to the elements of the disclosed embodiments that are known to those of ordinary skill in the art are expressly incorporated herein by reference and are intended to be encompassed by the present claims. Furthermore, no element, component, or method step in the present disclosure is intended to be dedicated to the public regardless of whether the element, component, or method step is explicitly recited in the claims. No claim element herein is to be construed as a "means plus function" element unless the element is expressly recited using the phrase "means for". No claim element herein is to be construed as a "step plus function" element unless the element is expressly recited using the phrase "step for".

What is claimed is:

1. A mobile fire hydrant apparatus, comprising:
(a) a base;
(b) a vertically ascending portion that ascends in a substantially perpendicular direction from said base;
(c) a first receptacle disposed within said base; and
(d) a second receptacle disposed within said vertically ascending portion;
(e) wherein a fluid input into the first receptacle will exit from the second receptacle after traversal of a least a portion of said base and said vertically ascending portion; and
(f) a switch configured to control a flow of the fluid as either on or off, wherein said switch is disposed on said vertically ascending section.

2. The apparatus of claim 1, wherein the first receptacle is configured to receive a hard suction hose.

3. The apparatus of claim 1, wherein the second receptacle is configured as a fire hydrant outlet.

4. The apparatus of claim 1, wherein said base and said vertically ascending portion comprise a material selected from the group consisting of copper piping, steel piping, stainless steel piping, galvanized steel piping, aluminum piping, a metal, a plastic, and polyvinylchloride (PVC).

5. The apparatus of claim 1, wherein said switch is either removably or permanently disposed on said vertically ascending portion.

6. The apparatus of claim 1, further comprising:
(a) a switch cable electrically connected to said switch;
(b) wherein said switch cable terminates at a switch connector.

7. The apparatus of claim 6, further comprising:
(a) a pump connector, comprising a top float cable and a bottom float cable;
(b) a pump, comprising a top float sensor input and a bottom float sensor input;
(c) wherein operation of the pump is controlled on or off by the top float sensor input and the bottom float sensor input;
(d) wherein the top float cable is attached to the top float sensor input, and wherein the bottom float cable is connected to the bottom float sensor input;
(e) wherein the switch cable is connected to the pump connector; and
(f) wherein the pump connector comprises a connection that electrically links the top float cable and the bottom float cable in at least one place.

8. A mobile fire hydrant apparatus, comprising:
(a) a base, comprising a first receptacle; and
(b) an ascending section, comprising a second receptacle;
(c) wherein the ascending section ascends from the base; and
(d) wherein the first and second receptacles are in fluid communication through the base and the ascending section; and
(e) a switch available to control a flow of the fluid as either on or off.

9. The apparatus of claim 8, wherein the first receptacle is configured to receive a hose.

10. The apparatus of claim 8, wherein the second receptacle is configured to be a fire hydrant outlet.

11. The apparatus of claim 8, wherein the base and the ascending portion are selected from a set of materials comprising: copper piping, steel piping, stainless steel piping, galvanized steel piping, aluminum piping, a metal, a plastic, and polyvinylchloride (PVC).

12. The apparatus of claim 8, wherein the switch is disposed on the ascending portion.

13. The apparatus of claim 12, further comprising:
(a) a switch cable electrically connected to the switch;
(b) wherein the switch cable terminates at a switch connector.

14. The apparatus of claim 13, further comprising:
(a) a pump connector, comprising a top float cable and a bottom float cable;
(b) a pump, comprising a top float sensor input and a bottom float sensor input;
(c) wherein operation of the pump is controlled on or off by the top float sensor input and the bottom float sensor input;
(d) wherein the top float cable is attached to the top float sensor input, and the bottom float cable is connected to the bottom float sensor input;

(e) wherein the switch cable is connected to the pump connector; and (f) wherein the pump connector comprises an electrical connection between the top float cable and the bottom float cable in at least one place.

15. A method of pumping water from a source, comprising:

(a) providing a pump having a pump inlet and a pump outlet;

(b) providing a mobile fire hydrant apparatus in fluid connection with the pump outlet at a first receptacle, the apparatus disposed at a distance from the source;

(c) wherein the apparatus comprises:

(i) a base, comprising the first receptacle;

(ii) an ascending section, comprising a second receptacle;

(iii) wherein the ascending section ascends from the base; and wherein the first and second receptacles are in fluid communication through the base and the ascending section; and (d) providing a hard suction hose between the water source and the pump inlet.

16. The method of claim 15, further comprising providing a switch available to control a flow of the water as either on or off.

17. The method of claim 16, wherein the switch is either removably or permanently disposed on the vertically ascending portion.

18. The method of claim 17, further comprising:

(a) providing a switch cable electrically connected to the switch;

(b) wherein the switch cable terminates at a switch connector.

19. The method of claim 17, further comprising:

(a) providing a pump connector, comprising a top float cable and a bottom float cable;

(b) providing a pump, comprising a top float sensor input and a bottom float sensor input;

(c) wherein operation of the pump is controlled on or off by the top float sensor input and the bottom float sensor input;

(d) wherein the top float cable is attached to the top float sensor input, and the bottom float cable is connected to the bottom float sensor input;

(e) wherein the switch cable is connected to the pump connector; and (f) providing an electrical connection linking the top float cable and the bottom float cable together in at least one place.

20. The method of claim 15, wherein the first receptacle is configured to receive a hose fluidly connecting the pump and the apparatus.

21. The method of claim 15, wherein the second receptacle is configured to be a fire hydrant outlet.

22. The method of claim 15, wherein the base and the ascending portion are selected from a set of materials comprising: copper piping, steel piping, stainless steel piping, galvanized steel piping, aluminum piping, a metal, a plastic, and polyvinylchloride (PVC).

* * * * *